US008919559B2

(12) United States Patent
Limback

(10) Patent No.: US 8,919,559 B2
(45) Date of Patent: Dec. 30, 2014

(54) PACKAGE WITH BREAK-AWAY CLAMSHELL

(75) Inventor: Nancy Gail Limback, Valley Park, MO (US)

(73) Assignee: Aventisub II Inc., Greenville, DE (US)

( * ) Notice: Subject to any disclaimer, the term of this patent is extended or adjusted under 35 U.S.C. 154(b) by 100 days.

(21) Appl. No.: 13/567,962

(22) Filed: Aug. 6, 2012

(65) Prior Publication Data

US 2013/0256179 A1 Oct. 3, 2013

Related U.S. Application Data

(63) Continuation-in-part of application No. 13/432,247, filed on Mar. 28, 2012.

(51) Int. Cl.
*B65D 73/00* (2006.01)

(52) U.S. Cl.
USPC ..... 206/469; 206/470; 206/471

(58) Field of Classification Search
USPC ..... 206/461–471
See application file for complete search history.

(56) References Cited

U.S. PATENT DOCUMENTS

| | | | | |
|---|---|---|---|---|
| D58,905 | S | 9/1921 | Harrington | |
| D117,605 | S | 11/1939 | Blunt | |
| 2,317,860 | A | 4/1943 | Sörensen | |
| D190,530 | S | 6/1961 | Bender et al. | |
| 3,054,503 | A | 9/1962 | Hartman, Jr. et al. | |
| 3,122,441 | A | 2/1964 | Smith | |
| D200,000 | S | 1/1965 | Richards et al. | |
| 3,255,928 | A | 6/1966 | Foster | |
| 3,331,495 | A | 7/1967 | Leckzik et al. | |
| 3,387,699 | A | 6/1968 | Heller | |
| 3,429,426 | A | 2/1969 | Wolf et al. | |
| 3,540,579 | A | 11/1970 | Hellstrom | |
| D220,750 | S | 5/1971 | Artz | |
| D220,752 | S | 5/1971 | Artz | |
| 3,613,879 | A * | 10/1971 | Kemble | 206/467 |
| 3,620,411 | A | 11/1971 | Rump | |
| D234,294 | S | 2/1975 | Gorman | |
| D249,491 | S | 9/1978 | Bernhardt | |
| D253,040 | S | 10/1979 | Fournier et al. | |

(Continued)

FOREIGN PATENT DOCUMENTS

| | | | |
|---|---|---|---|
| WO | 99/11195 | A1 | 3/1999 |
| WO | 2007/141869 | A1 | 12/2007 |

OTHER PUBLICATIONS

U.S. Office Action dated Oct. 3, 2012 issued in U.S. Appl. No. 29/416,879.

(Continued)

*Primary Examiner* — Bryon Gehman
(74) *Attorney, Agent, or Firm* — Scully, Scott, Murphy & Presser, P.C.

(57) ABSTRACT

A package for accommodating, storing, displaying and transporting an article, such as, pharmaceutical products. The package has a receptacle mountable to a paperboard. The mountable receptacle has a clamshell for receiving, for example, one or more blister cards. The clamshell has a first portion having a first edge and a second portion having a second edge, which opposes the first edge. The mountable receptacle has an extension connected at least to the second edge through a breakable mechanism. The extension is attached to a surface of the paperboard, such that the clamshell can be detached from the paperboard by breaking the breakable mechanism.

13 Claims, 11 Drawing Sheets

(56) References Cited

U.S. PATENT DOCUMENTS

| | | | |
|---|---|---|---|
| D253,167 | S | 10/1979 | Fournier et al. |
| D253,222 | S | 10/1979 | Fournier et al. |
| D253,515 | S | 11/1979 | Meierhoefer |
| D253,516 | S | 11/1979 | Meierhoefer |
| D253,751 | S | 12/1979 | Meierhoefer |
| 4,234,084 | A | 11/1980 | Hutten |
| 4,266,666 | A | 5/1981 | Kuchenbecker |
| D271,283 | S | 11/1983 | Taylor |
| 4,537,312 | A | 8/1985 | Intini |
| D280,387 | S | 9/1985 | Morgan |
| 4,574,951 | A | 3/1986 | Weaver |
| D285,176 | S | 8/1986 | Kodousek et al. |
| D286,140 | S | 10/1986 | Kodousek et al. |
| 4,660,991 | A | 4/1987 | Simon |
| 4,805,377 | A | 2/1989 | Carter |
| 4,817,819 | A | 4/1989 | Kelly |
| 4,838,425 | A | 6/1989 | O'Brien et al. |
| D303,931 | S | 10/1989 | Miller et al. |
| 4,876,843 | A | 10/1989 | O'Brien et al. |
| D305,000 | S | 12/1989 | Hernandez |
| 4,884,693 | A | 12/1989 | Brutsch |
| 4,890,763 | A | 1/1990 | Curiel |
| D305,870 | S | 2/1990 | Perkins |
| D306,405 | S | 3/1990 | Kuerti |
| D306,825 | S | 3/1990 | Siegel |
| 4,905,866 | A | 3/1990 | Bartell et al. |
| D307,554 | S | 5/1990 | McAlister, Sr. |
| 4,945,708 | A | 8/1990 | Curiel |
| 4,947,620 | A | 8/1990 | Carter |
| 4,955,481 | A | 9/1990 | Novinski et al. |
| D311,332 | S | 10/1990 | Miller et al. |
| 4,962,856 | A | 10/1990 | Carter |
| D313,182 | S | 12/1990 | Diepois |
| 4,975,015 | A | 12/1990 | Harding |
| 4,988,004 | A | 1/1991 | Intini |
| 4,998,623 | A | 3/1991 | Doull |
| 5,014,851 | A | 5/1991 | Wick |
| 5,033,251 | A | 7/1991 | Rodriguez |
| 5,033,252 | A | 7/1991 | Carter |
| 5,040,353 | A | 8/1991 | Evans et al. |
| D319,577 | S | 9/1991 | Schwarz |
| 5,046,618 | A | 9/1991 | Wood |
| 5,050,739 | A | 9/1991 | Hannan et al. |
| 5,052,558 | A | 10/1991 | Carter |
| 5,067,611 | A | 11/1991 | Hagmann et al. |
| D325,526 | S | 4/1992 | Deguchi et al. |
| 5,109,984 | A | 5/1992 | Romick |
| D327,425 | S | 6/1992 | Hamada et al. |
| D327,426 | S | 6/1992 | Karita et al. |
| 5,129,527 | A | 7/1992 | Lataix |
| 5,150,793 | A | 9/1992 | Tannenbaum |
| D331,011 | S | 11/1992 | Karita et al. |
| D331,012 | S | 11/1992 | Karita et al. |
| 5,172,812 | A | 12/1992 | Wharton et al. |
| 5,203,455 | A | 4/1993 | Hewelt et al. |
| D336,040 | S | 6/1993 | Philippe |
| 5,244,091 | A | 9/1993 | Tannenbaum |
| 5,251,757 | A | 10/1993 | Relyea et al. |
| 5,310,060 | A | 5/1994 | Bitner et al. |
| 5,323,587 | A | 6/1994 | Amaranti |
| 5,323,907 | A | 6/1994 | Kalvelage |
| 5,344,018 | A | 9/1994 | Severin |
| D351,343 | S | 10/1994 | Kellar et al. |
| 5,358,118 | A | 10/1994 | Thompson et al. |
| D352,236 | S | 11/1994 | Althaus |
| D352,237 | S | 11/1994 | Reardon et al. |
| 5,360,116 | A | 11/1994 | Schmiletzky |
| 5,363,968 | A | 11/1994 | Soloman |
| D353,092 | S | 12/1994 | Green |
| D354,911 | S | 1/1995 | Weatherford et al. |
| 5,377,839 | A | 1/1995 | Relyea et al. |
| 5,412,372 | A | 5/1995 | Parkhurst et al. |
| 5,415,321 | A | 5/1995 | Gehlert et al. |
| D359,678 | S | 6/1995 | Weatherford et al. |
| D359,679 | S | 6/1995 | Weatherford et al. |
| 5,437,371 | A | 8/1995 | Lataix |
| 5,442,892 | A | 8/1995 | Burns, III et al. |
| 5,450,710 | A | 9/1995 | Jensen et al. |
| 5,457,895 | A | 10/1995 | Thompson et al. |
| 5,460,471 | A | 10/1995 | Connor et al. |
| 5,469,968 | A | 11/1995 | Matthews et al. |
| D366,829 | S | 2/1996 | Chervenak et al. |
| 5,489,025 | A | 2/1996 | Romick |
| 5,509,773 | A | 4/1996 | Connor et al. |
| 5,522,506 | A | 6/1996 | Roulin et al. |
| 5,529,188 | A | 6/1996 | Coggswell |
| 5,549,204 | A | 8/1996 | Toren |
| D373,530 | S | 9/1996 | Levy et al. |
| 5,555,707 | A | 9/1996 | Schwenger |
| 5,560,490 | A | 10/1996 | Chawla |
| 5,603,201 | A * | 2/1997 | LaFata et al. ..... 206/471 |
| D378,272 | S | 3/1997 | Weatherford et al. |
| 5,624,036 | A | 4/1997 | Roulin et al. |
| 5,630,347 | A | 5/1997 | Elvio |
| D380,960 | S | 7/1997 | Blotsky |
| D382,474 | S | 8/1997 | Malmborg |
| D384,283 | S | 9/1997 | Davies et al. |
| D385,024 | S | 10/1997 | Roberts |
| D386,681 | S | 11/1997 | Reil |
| D387,977 | S | 12/1997 | Kallgren |
| 5,695,063 | A | 12/1997 | Roulin et al. |
| D391,156 | S | 2/1998 | Stevens |
| D392,562 | S | 3/1998 | Lo |
| D392,802 | S | 3/1998 | Malmborg |
| D392,883 | S | 3/1998 | Ferrin |
| 5,722,563 | A | 3/1998 | Hunts |
| 5,740,938 | A | 4/1998 | Hofmann et al. |
| D394,003 | S | 5/1998 | Tate |
| 5,752,615 | A | 5/1998 | Hofmann et al. |
| 5,756,577 | A | 5/1998 | Gutierrez-Villarreal |
| 5,758,774 | A | 6/1998 | Leblong |
| 5,775,505 | A | 7/1998 | Vasquez et al. |
| 5,785,180 | A | 7/1998 | Dressel et al. |
| 5,786,598 | A | 7/1998 | Clark et al. |
| 5,791,478 | A | 8/1998 | Kalvelage et al. |
| 5,794,781 | A | 8/1998 | Roulin et al. |
| D398,521 | S | 9/1998 | Coe |
| 5,802,804 | A | 9/1998 | Esposti et al. |
| 5,819,940 | A | 10/1998 | Roulin et al. |
| 5,833,071 | A | 11/1998 | Ray |
| 5,833,072 | A | 11/1998 | Lambelet, Jr. |
| D403,955 | S | 1/1999 | Siegel et al. |
| D404,644 | S | 1/1999 | Meeker |
| 5,858,401 | A | 1/1999 | Bhalani et al. |
| D405,361 | S | 2/1999 | Cameron et al. |
| 5,873,860 | A | 2/1999 | Kahlert |
| 5,878,887 | A | 3/1999 | Parker et al. |
| 5,879,612 | A | 3/1999 | Zeiter et al. |
| D408,278 | S | 4/1999 | Konop |
| 5,904,249 | A | 5/1999 | Roulin et al. |
| D411,445 | S | 6/1999 | Anderson |
| 5,911,319 | A | 6/1999 | Porcelli et al. |
| 5,911,325 | A | 6/1999 | Breitler |
| 5,913,418 | A | 6/1999 | Singh |
| 5,927,500 | A | 7/1999 | Godfrey et al. |
| 5,944,191 | A | 8/1999 | Ray et al. |
| D414,106 | S | 9/1999 | Anderson |
| 5,954,204 | A | 9/1999 | Grabowski |
| D415,416 | S | 10/1999 | Anderson et al. |
| D416,484 | S | 11/1999 | Voden |
| D417,148 | S | 11/1999 | Anderson et al. |
| 5,975,304 | A | 11/1999 | Cain et al. |
| D419,439 | S | 1/2000 | Markovsky et al. |
| 6,010,784 | A | 1/2000 | Peterson |
| 6,024,222 | A | 2/2000 | Friberg et al. |
| D421,385 | S | 3/2000 | Meeker et al. |
| D421,899 | S | 3/2000 | Eneroth et al. |
| D421,900 | S | 3/2000 | Eneroth et al. |
| 6,036,016 | A | 3/2000 | Arnold |
| 6,053,321 | A | 4/2000 | Kayser |
| 6,055,794 | A | 5/2000 | Breitler |
| D427,061 | S | 6/2000 | Niksich |
| 6,082,544 | A | 7/2000 | Romick |
| D430,015 | S | 8/2000 | Himbert et al. |

(56) References Cited

U.S. PATENT DOCUMENTS 6,109,000 A 8/2000 Conti
D431,459 S 10/2000 Lee
D431,863 S 10/2000 Richardson
6,135,755 A 10/2000 Zeiter et al.
6,138,830 A 10/2000 Muggli
6,155,414 A 12/2000 Vaessen
6,155,423 A 12/2000 Katzner et al.
6,161,699 A 12/2000 Gartland
6,170,663 B1 1/2001 Glassman
D438,104 S 2/2001 Hacker et al.
D438,461 S 3/2001 Yamagishi
D438,463 S 3/2001 Schill et al.
D438,607 S 3/2001 Edwards et al.
D440,871 S 4/2001 Lo
6,212,791 B1 4/2001 Thompson et al.
6,212,858 B1 4/2001 Breitler
D441,284 S 5/2001 Saur et al.
6,227,369 B1 * 5/2001 Glassman ..... 206/469
D444,056 S 6/2001 Lo
6,244,442 B1 6/2001 Inoue et al.
D444,379 S 7/2001 Assargren et al.
6,269,671 B1 8/2001 Zeiter et al.
6,270,869 B1 8/2001 Zeiter et al.
D449,779 S 10/2001 Otto
D449,780 S 10/2001 Corella
D450,239 S 11/2001 Otto
D451,014 S 11/2001 Otto
D451,015 S 11/2001 Otto
D451,016 S 11/2001 Dittmar
6,311,743 B1 11/2001 Baroncini
6,329,047 B1 12/2001 Beer et al.
6,345,717 B1 2/2002 Flewitt
6,349,831 B1 2/2002 Buss
D454,781 S 3/2002 Assargren et al.
6,357,495 B1 3/2002 Baroncini
D455,344 S 4/2002 Assargren et al.
D455,345 S 4/2002 Assargren et al.
D455,953 S 4/2002 Assargren et al.
D455,954 S 4/2002 Dittmar
6,401,926 B1 6/2002 Lo
6,409,020 B1 6/2002 Lo
6,411,567 B1 6/2002 Niemiec et al.
6,430,984 B2 8/2002 Zeiter et al.
6,439,426 B1 8/2002 Baroncini
6,497,083 B1 12/2002 Garwood et al.
D469,348 S 1/2003 Demus et al.
6,502,374 B1 1/2003 Llorca Chulia
6,516,949 B2 2/2003 Fuller et al.
6,564,934 B1 5/2003 Dischler
D476,227 S 6/2003 Pratt
6,574,166 B2 6/2003 Niemiec
D477,158 S 7/2003 Calcerano et al.
6,588,180 B2 7/2003 Heath et al.
6,589,616 B2 7/2003 Muggli et al.
6,589,642 B1 7/2003 Miller et al.
6,592,978 B1 7/2003 Miller et al.
6,598,370 B2 7/2003 Baroncini
D478,810 S 8/2003 Wilson
6,601,876 B1 8/2003 Instance
D480,635 S 10/2003 Caroen
6,648,575 B2 11/2003 Baroncini
6,669,236 B1 12/2003 Höllwarth-Oberholz
6,673,406 B2 1/2004 Bekele
6,675,972 B2 1/2004 Patterson
6,679,382 B1 1/2004 Kancsar et al.
6,699,566 B2 3/2004 Zeiter et al.
6,705,467 B1 3/2004 Kancsar et al.
6,706,345 B1 3/2004 Yoon
6,708,825 B2 3/2004 Filion et al.
D489,002 S 4/2004 Meyer et al.
6,726,054 B2 4/2004 Fagen et al.
D491,459 S 6/2004 Grant
6,757,637 B2 6/2004 Mertens et al.
6,758,367 B2 7/2004 Hunts
D495,134 S 8/2004 Geert-Jensen et al.
6,793,077 B1 9/2004 Kancsar et al.
6,802,422 B2 10/2004 Kalvelage et al.
6,805,259 B2 10/2004 Stevens et al.
6,805,528 B2 10/2004 Monti
6,827,808 B2 12/2004 Fenn
6,839,304 B2 1/2005 Niemiec et al.
D501,790 S 2/2005 Feibelman
6,848,580 B2 2/2005 Paliotta et al.
6,851,874 B2 2/2005 Gonzalez et al.
D504,811 S 5/2005 Haingaertner
D505,320 S 5/2005 Gattefosse et al.
D505,322 S 5/2005 Guthrie et al.
6,889,690 B2 5/2005 Crowder et al.
6,890,472 B2 5/2005 Heath
6,896,139 B2 5/2005 Kancsar et al.
D506,680 S 6/2005 Saelzer
6,902,645 B2 6/2005 Miller
D507,453 S 7/2005 Mills
6,925,783 B1 8/2005 Pearson
6,941,947 B2 9/2005 Young et al.
6,951,353 B2 10/2005 Kozlowski et al.
D511,452 S 11/2005 Dibnah et al.
D511,977 S 11/2005 Saelzer
6,959,841 B2 11/2005 Vlodek
6,964,338 B2 11/2005 Kancsar et al.
6,974,031 B2 12/2005 Kancsar et al.
6,974,032 B2 12/2005 Intini
6,978,894 B2 12/2005 Mundt
D513,589 S 1/2006 Grant
D513,863 S 1/2006 Wahl et al.
D513,976 S 1/2006 Milan
6,988,618 B2 1/2006 DeJonge
D514,308 S 2/2006 Wahl et al.
D514,309 S 2/2006 Wahl et al.
D514,436 S 2/2006 McGuinness
D515,924 S 2/2006 Grant
D515,925 S 2/2006 Wahl et al.
D515,926 S 2/2006 Wahl et al.
6,997,320 B1 2/2006 Kancsar et al.
7,000,768 B2 2/2006 Morita et al.
D517,410 S 3/2006 Grant
D518,721 S 4/2006 Wahl et al.
7,025,207 B2 4/2006 Breu et al.
D520,357 S 5/2006 Terrasi
7,038,219 B2 5/2006 Clark et al.
7,055,296 B2 6/2006 Christ
7,063,211 B2 6/2006 Williams-Hartman
7,067,084 B1 6/2006 Leroy et al.
7,069,929 B2 7/2006 Young et al.
7,070,802 B1 7/2006 Bhalani et al.
7,080,644 B2 7/2006 Gumaste
7,090,079 B2 8/2006 Ehrlund
7,093,716 B2 8/2006 Intini
7,104,035 B2 9/2006 Hähnel
7,121,065 B2 10/2006 Christ
7,121,822 B2 10/2006 Heath
7,128,100 B2 10/2006 Monti
D533,971 S 12/2006 Carter et al.
D534,423 S 1/2007 Tanner
7,188,728 B2 3/2007 Williams-Hartman
7,192,640 B2 3/2007 Holbert et al.
7,207,440 B2 4/2007 Briscoe
7,207,441 B2 4/2007 Ritter
D543,103 S 5/2007 Roche et al.
D544,794 S 6/2007 White
D545,690 S 7/2007 Tsutsumi et al.
D546,182 S 7/2007 Hanji et al.
D546,198 S 7/2007 Currie et al.
7,243,798 B2 7/2007 Buss
D548,110 S 8/2007 Pugh
D548,615 S 8/2007 Ristic et al.
D554,530 S 11/2007 Tsutsumi et al.
D556,602 S 12/2007 Clements et al.
D556,603 S 12/2007 Barnes et al.
D558,336 S 12/2007 Walters et al.
D559,706 S 1/2008 Clements et al.
7,318,304 B2 1/2008 Hiddink et al.
D562,153 S 2/2008 Ruble et al.
7,325,689 B2 2/2008 Buss

(56) References Cited

U.S. PATENT DOCUMENTS

| | | | | |
|---|---|---|---|---|
| 7,325,703 | B2 | 2/2008 | Gherdan et al. | |
| 7,331,460 | B2 | 2/2008 | Barndt et al. | |
| 7,337,593 | B2 | 3/2008 | Blum et al. | |
| 7,337,906 | B2 | 3/2008 | Chang | |
| 7,377,394 | B2 | 5/2008 | Buss | |
| D570,171 | S | 6/2008 | Benktzon et al. | |
| 7,383,674 | B2 | 6/2008 | Van Eenoo | |
| 7,387,206 | B2 | 6/2008 | Grosskopf | |
| 7,401,702 | B2 | 7/2008 | Hession | |
| D574,704 | S | 8/2008 | Senter | |
| 7,410,056 | B2 * | 8/2008 | Cafferata et al. | 206/471 |
| 7,416,631 | B2 | 8/2008 | Pasternicki | |
| 7,419,056 | B2 | 9/2008 | Gattefosse et al. | |
| 7,429,127 | B2 | 9/2008 | Walker et al. | |
| D578,386 | S | 10/2008 | Silvenis et al. | |
| 7,448,182 | B2 | 11/2008 | Pearson | |
| 7,448,184 | B2 | 11/2008 | Clark et al. | |
| 7,451,761 | B2 | 11/2008 | Hickey et al. | |
| D581,780 | S | 12/2008 | Senter | |
| D582,240 | S | 12/2008 | Benktzon et al. | |
| 7,464,818 | B2 | 12/2008 | Gherdan et al. | |
| D585,545 | S | 1/2009 | Carrio et al. | |
| 7,472,526 | B2 | 1/2009 | Pearson | |
| D585,638 | S | 2/2009 | Skedelius | |
| D585,735 | S | 2/2009 | Vovan et al. | |
| D588,471 | S | 3/2009 | Fluegel et al. | |
| D588,908 | S | 3/2009 | Silvenis et al. | |
| D590,245 | S | 4/2009 | Nanda | |
| 7,516,836 | B2 | 4/2009 | Trygar et al. | |
| 7,523,594 | B2 | 4/2009 | Greenwald et al. | |
| D592,947 | S | 5/2009 | Neves et al. | |
| D594,753 | S | 6/2009 | Eadicicco et al. | |
| 7,540,383 | B2 | 6/2009 | Huffer et al. | |
| 7,552,824 | B2 | 6/2009 | Le et al. | |
| D597,418 | S | 8/2009 | Stojek | |
| D597,830 | S | 8/2009 | Andersen et al. | |
| D598,737 | S | 8/2009 | Neves et al. | |
| D598,785 | S | 8/2009 | Stojek | |
| D601,012 | S | 9/2009 | Ginsberg et al. | |
| 7,591,372 | B2 | 9/2009 | Gelardi et al. | |
| D601,884 | S | 10/2009 | Andre et al. | |
| 7,607,539 | B2 | 10/2009 | Freeze | |
| 7,617,935 | B2 | 11/2009 | Reilley et al. | |
| 7,623,040 | B1 | 11/2009 | Cote | |
| D606,856 | S | 12/2009 | Ginsberg et al. | |
| 7,637,079 | B2 | 12/2009 | Klingel et al. | |
| 7,637,375 | B2 | 12/2009 | Sattel et al. | |
| D608,192 | S | 1/2010 | L'Hoste et al. | |
| 7,661,531 | B2 | 2/2010 | Intini | |
| 7,665,610 | B2 | 2/2010 | Williams-Hartman | |
| 7,674,532 | B2 | 3/2010 | Einhorn et al. | |
| 7,685,798 | B2 | 3/2010 | Marzocchi | |
| D614,045 | S | 4/2010 | Gaudenzi et al. | |
| 7,690,511 | B2 | 4/2010 | Arnold et al. | |
| 7,699,173 | B2 | 4/2010 | Hession | |
| 7,704,583 | B2 | 4/2010 | Heath | |
| 7,721,880 | B2 | 5/2010 | Pearce et al. | |
| 7,726,485 | B2 | 6/2010 | Brollier | |
| 7,726,486 | B2 | 6/2010 | Jones | |
| 7,735,650 | B2 | 6/2010 | Zumbiel | |
| D620,359 | S | 7/2010 | Ginsberg et al. | |
| D620,375 | S | 7/2010 | Sadler et al. | |
| 7,748,535 | B2 | 7/2010 | Grosskopf | |
| 7,756,248 | B2 | 7/2010 | Beckers et al. | |
| 7,758,936 | B2 | 7/2010 | Spallek et al. | |
| D620,812 | S | 8/2010 | Gaudenzi et al. | |
| 7,784,250 | B2 | 8/2010 | Grosskopf | |
| D624,399 | S | 9/2010 | Hansen et al. | |
| D624,402 | S | 9/2010 | Hansen et al. | |
| D624,403 | S | 9/2010 | Hansen et al. | |
| 7,793,784 | B2 | 9/2010 | Nivala | |
| 7,798,328 | B2 | 9/2010 | Hession | |
| 7,798,329 | B2 | 9/2010 | Gelardi | |
| 7,799,340 | B2 | 9/2010 | Bhalani et al. | |
| D624,785 | S | 10/2010 | Rousselin | |
| D624,815 | S | 10/2010 | Hansen et al. | |
| 7,810,495 | B2 | 10/2010 | Gumaste | |
| D627,220 | S | 11/2010 | LeMaster et al. | |
| D627,239 | S | 11/2010 | Bontorno et al. | |
| 7,828,147 | B2 | 11/2010 | Caracciolo et al. | |
| 7,828,149 | B2 | 11/2010 | Kalvelage et al. | |
| 7,828,150 | B2 | 11/2010 | Taylor et al. | |
| 7,854,325 | B2 | 12/2010 | Bentele | |
| 7,866,475 | B2 | 1/2011 | Doskoczynski et al. | |
| D632,955 | S | 2/2011 | Smith, III et al. | |
| 7,891,492 | B2 | 2/2011 | Wenninger et al. | |
| D634,616 | S | 3/2011 | Hansen et al. | |
| D635,468 | S | 4/2011 | Buitrago | |
| D635,469 | S | 4/2011 | Buitrago | |
| 7,919,171 | B2 | 4/2011 | Young | |
| 7,926,660 | B2 | 4/2011 | Jones et al. | |
| 7,931,148 | B2 | 4/2011 | Hansen et al. | |
| D637,391 | S | 5/2011 | Stevens et al. | |
| 7,934,355 | B2 | 5/2011 | Strub et al. | |
| 7,937,829 | B2 | 5/2011 | Petersen et al. | |
| 7,939,150 | B2 | 5/2011 | Altman et al. | |
| 7,950,390 | B2 | 5/2011 | Gumaste | |
| 7,959,004 | B2 | 6/2011 | Tsao | |
| 7,959,005 | B2 | 6/2011 | Berg et al. | |
| 7,963,089 | B2 | 6/2011 | Nelson et al. | |
| D641,616 | S | 7/2011 | Prevost | |
| 7,977,378 | B1 | 7/2011 | Villalobos | |
| 7,988,995 | B1 | 8/2011 | Bhalani et al. | |
| 8,091,704 | B2 | 1/2012 | Trigg | |
| D691,467 | S | 10/2013 | Limback | |
| D693,219 | S | 11/2013 | Limback | |
| D693,695 | S | 11/2013 | Limback | |
| D694,621 | S | 12/2013 | McCarthy et al. | |
| 2005/0098467 | A1 | 5/2005 | Agakanian | |
| 2007/0029223 | A1 * | 2/2007 | Mazurek | 206/463 |

OTHER PUBLICATIONS

U.S. Notice of Allowance dated Mar. 25, 2013 issued in U.S. Appl. No. 29/416,878.

U.S. Office Action dated Mar. 25, 2013 issued in U.S. Appl. No. 29/416,880.

U.S. Office Action dated Mar. 25, 2013 issued in U.S. Appl. No. 29/416,882.

U.S. Office Action dated Apr. 1, 2013 issued in U.S. Appl. No. 29/429,017.

Invitation to Pay Additional Fees and, Where Applicable, Protest Fee mailed Jul. 10, 2013.

U.S. Office Action dated Jul. 15, 2013 issued in U.S. Appl. No. 13/432,247.

U.S. Office Action dated Jul. 18, 2013 issued in U.S. Appl. No. 29/429,016.

Notice of Allowance mailed on Feb. 6, 2014 issued in Design U.S. Appl. No. 29/465,591.

Notice of Allowance issued on Dec. 26, 2013 in Design U.S. Appl. No. 29/467,717.

Office Action issued on Jan. 7, 2014 in U.S. Appl. No. 13/432,247.

International Search Report and Written Opinion issued in International Application No. PCT/US2013/033964 mailed Oct. 11, 2013.

* cited by examiner

PACKAGE WITH BREAK-AWAY CLAMSHELL

CROSS-REFERENCE TO RELATED APPLICATION

The present application is a continuation-in-part application of U.S. patent application Ser. No. 13/432,247, filed Mar. 28, 2012, entitled "PACKAGE WITH BREAK-AWAY CLAMSHELL", the complete disclosure of which application is hereby incorporated by reference for all purposes.

BACKGROUND

The present invention relates generally to improved packaging for accommodating, storing, displaying and transporting articles, such as pharmaceuticals.

Packages, such as clamshells, are commonly used in industry to store, display, and ship products as well as exhibit information related to the products. Typically, when a user intends to access the products contained in the clamshell, the user needs to break the clamshell, which renders the clamshell non-reusable. Typically, the known clamshells are not capable of standing by themselves, which makes it difficult to organize the clamshells on a shelf. In addition, it is desirable for the packaging, particularly in the area of pharmaceuticals, to discourage and/or provide evidence of tampering. That is, a package should ensure that, absent evidence (e.g., visual, tactile, etc.) of tampering, the product within the package has not been altered since it left the manufacturer. Similarly, it is desirable that the products contained within such packages not be accessible by anyone but the end user.

Therefore, it is desirable to provide a novel package for articles, particularly pharmaceuticals, which discourages and/or provides evidence of tampering, improves display of the articles, permits the package to stand on its own or stand in a group package, e.g., align in a group on a tray, permits the package to be peggable during use, and permits the end user to selectively reuse the package for same or different articles.

SUMMARY

As described herein, the exemplary embodiments of the present invention overcome one or more of the above and other disadvantages known in the art.

An exemplary aspect of the present invention relates to package for an article. The package includes a paperboard on which information related to the article is shown. The package further includes a receptacle detachably mountable to the paperboard. The mountable receptacle includes a clamshell, which includes a first portion having a first edge and a second portion having a second edge opposing the first edge. The mountable receptacle further includes at least one substantially flat extension connected at least to the second edge through a breakable mechanism. The flat extension is attached to a surface of the paperboard to attach the clamshell to the paperboard, such that the clamshell can be detached from the paperboard by breaking the breakable mechanism.

The package according to the present invention can be used to contain a variety of articles, which include, but are not limited to, pharmaceuticals (such as tablets, pills, capsule and the like), foods (such as candies, cookies, chewing gums and the like), office supplies (such as paper clips, binders, rolls of tapes and the like), hardware items (such as screws, bolts, nails, nuts and the like), personal belongs (such as jewelries, watches and the like).

In one embodiment, the package further includes one or more blister cards received within the clamshell. Each blister card includes a blister sheet having at least one blister formed concavely for loading the article. The blister can be a push-through-backing-material type blister, a peel-and-push type blister, a tear-notch type blister, or any other suitable blister.

In one embodiment, the at least one substantially flat extension includes a pair of wings disposed oppositely to one another. However, the substantially flat extension can be of any suitable shape (such as square, rectangular and the like) or desirable shape (such as a shape resembling a letter, number, symbol or image).

In one embodiment, the at least one substantially flat extension is spot-welded or face-sealed to the surface of the paperboard.

In one embodiment, the at least one blister has a first width extending perpendicularly from the blister sheet, and the rib includes at least one foot portion having a second width extending perpendicularly from the blister sheet, the second width being equal to or larger than the first width such that a plurality of the blister cards can be stacked within the clamshell without the blisters contacting with one another. In addition, the foot portion protects the article within the blister from forces applied on the article and distributes stress exerted by outside forces on the package.

In one embodiment, the blister sheet and the peripheral rib are substantially A-shaped, and the clamshell has a profile substantially matching the A-shaped blister sheet. The blister sheet and peripheral rib can be of any suitable or desirable shape or profile. For example, the blister sheet and the peripheral rib can be of any numeral or alphabetic shape, any shape resembling a symbol or image, or any arbitrary shape depending on design choices.

In one embodiment, the rib is disposed to at least partially surround the at least one blister. However, the rib may be absent or fully surround the blister as desired.

In one embodiment, the blister card further includes a rib disposed on the blister sheet at the same side of the at least one blister.

In one embodiment, the clamshell further includes a hinge for pivotably joining the first portion and the second portion of the clamshell. The clamshell can include other connecting means, such as tapes, staples and the like, to join the first portion and the second portion. Alternatively, the clamshell can include two physically separate portions, which can be snapped together by frictional engagement or through the geometry of the portions.

In one embodiment, the breakable mechanism includes, but is not limited to, a plurality of perforations, laser scoring, locally weakened material and the like.

In one embodiment, the clamshell includes a bottom portion for permitting the clamshell to stand independently. The bottom portion can be formed with either the first portion or the second portion. The bottom portion includes a pair of feet spaced by a void.

Another exemplary aspect of the present invention relates to a method of producing a package for an article. The package includes a paperboard and a clamshell mounted to the paperboard. The method includes providing at least one substantially planar extension for the clamshell; connecting the at least one substantially planar extension to the clamshell through a breakable mechanism; and attaching the at least one substantially planar extension to a surface of the paperboard to attach the clamshell to the paperboard.

In one embodiment, the providing step includes providing a pair of extensions, for example, wing-shaped extension. For example, the connecting step includes connecting the pair of extensions to either side of the clamshell, respectively, through a plurality of perforations. The substantially flat extension can be of any suitable or desirable shape or profile.

In one embodiment, the attaching step includes at least partially spot-welding or heat-sealing the at least one substantially planar extension to the surface of the paperboard.

BRIEF DESCRIPTION OF THE DRAWINGS

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, the drawings are merely intended to illustrate the structures and procedures described herein.

DETAILED DESCRIPTION OF EXEMPLARY EMBODIMENTS

Figure 1:
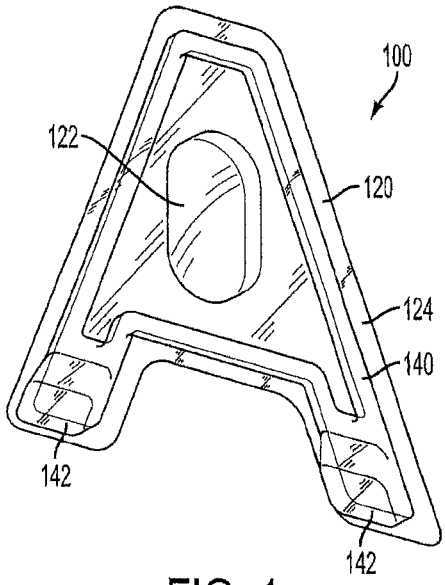
FIG. 1 is a perspective view a blister card according to an exemplary embodiment of the present invention.

FIG. 1 is a perspective view of a blister card 100 according to an exemplary embodiment of the present invention. The blister card 100 includes a substantially A-shaped blister sheet 120, which has a blister 122 formed concavely from a surface 124 of the blister sheet 120 for loading an article, such as pharmaceuticals, for example, a tablet, pill or capsule. The blister card 100 further includes a substantially A-shaped peripheral rib 140 extending perpendicularly from the same surface 124 for at least partially surrounding the blister 122. The rib 140 can be continuous or include a plurality of segregated sections. The rib 140 includes at least one foot portion 142 (for example, a pair of foot portions 142 shown in FIG. 1) disposed at the lower end of the blister card 100.

Figure 2:
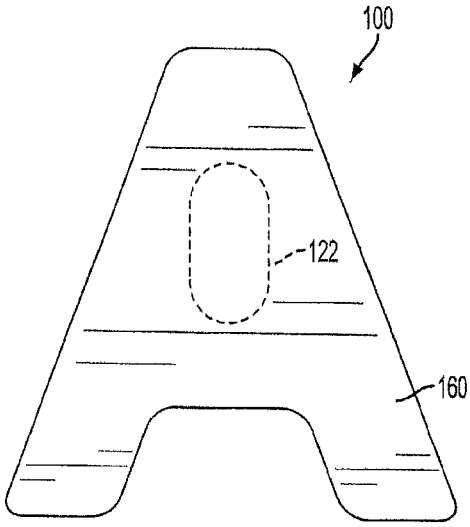
FIG. 2 is a rear elevation view of the blister card shown in FIG. 1.

FIG. 2 shows the backside of the blister card 100. The blister card 100 includes a backing material 160, which covers the back of the blister sheet 120. The backing material 160 is selected to permit a user to push the article out of the blister 122 though the backing material, thereby providing a push-through-backing-material type blister. The blister can be any child-resistant blister, such as a peel-and-push type blister or a tear-notch type blister, or any non-child-resistant blister.

Figure 3:
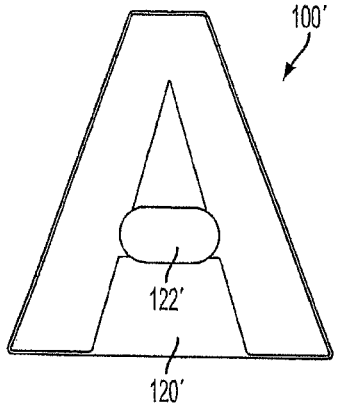
FIG. 3 is a perspective view a blister card according to another exemplary embodiment of the present invention.
Figure 4:
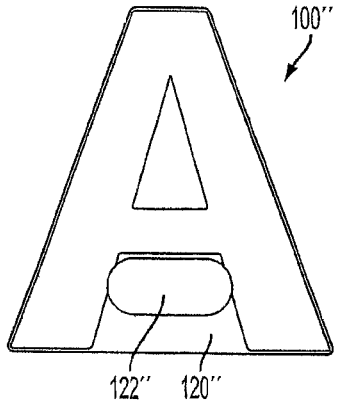
FIG. 4 is a perspective view a blister card according to another exemplary embodiment of the present invention.

The location of the blister with respect to the blister sheet can be varied, depending on the design considerations and the desire of skilled persons in the art. For example, FIG. 3 illustrates a blister card 100' according to another embodiment of the present invention, in which a blister 122' is disposed substantially horizontally at approximately the middle of a blister sheet 120'. FIG. 4 illustrates a blister card 100" according to still another embodiment of the present invention, in which a blister 122" is disposed substantially horizontally at approximately the lower end of a blister sheet 120".

The shape and profile of the blister card 100 are not limited to the embodiment shown in FIGS. 1 and 3-4. For example, the shape and profile of the blister sheet 120 and the rib 140 can be rectangular, square, oval, round or follow any other letter, number or symbol.

Figure 5:
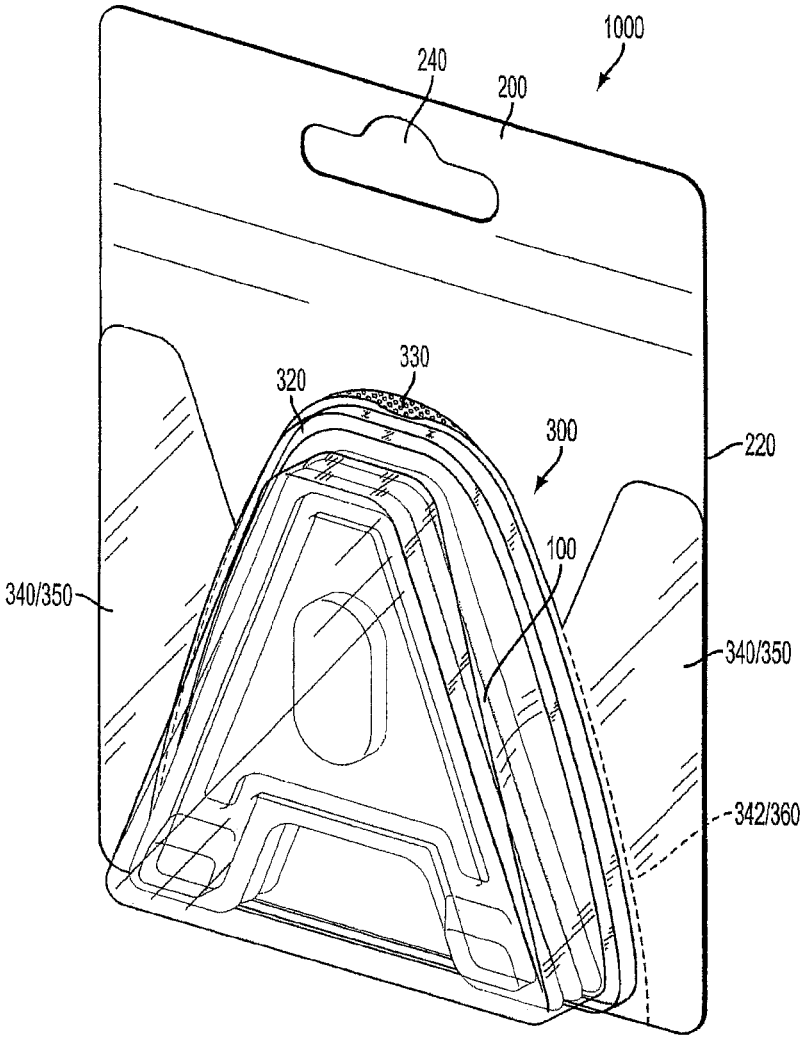
FIG. 5 is a perspective view of a package according to another exemplary embodiment of the present invention.

FIG. 5 is a perspective view of a package 1000 for an article, according to another aspect of the present invention. The package 1000 includes a paperboard 200 on which information related to the article is printed, and a receptacle 300 detachably mountable to the paperboard 200 and configured to receive one or more of the blister cards 100.

Figure 6:
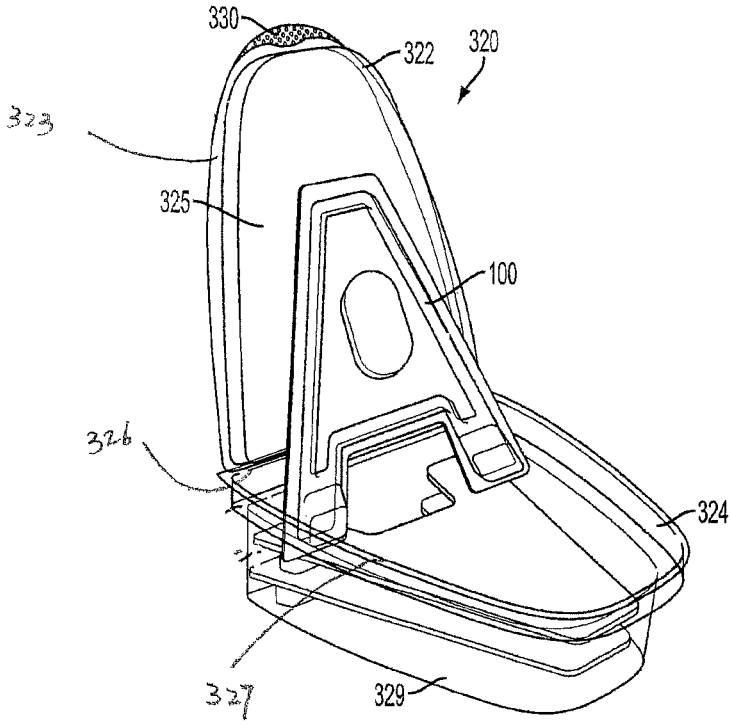
FIG. 6 is a perspective view of a mountable receptacle having a clamshell according to another exemplary embodiment of the present invention.

The mountable receptacle 300 includes a clamshell 320 for receiving one or more blister cards 100. As best shown in FIG. 6, the clamshell 320 includes a first portion 322 and a second portion 324. The two portions 322 and 324 can be, for example, pivotably jointed to one another through a hinge 326. The first portion 322 and the second portion 324 can be joined through other connecting means, such as tapes, staples and the like. Alternatively, the clamshell can include two physically separate portions, which can be snapped together by frictional engagement or through the geometry of the portions.

The first portion 322 includes a first edge 323, which is substantially planar, and a cover 325, which is recessed from the first edge 323. The second portion 324 includes a substantially planar second edge 327 and a container 329 substantially surrounded by the second edge 327. The cover 325 and the container 329 are dimensioned, such that when the first portion 322 is pivoted toward the second portion 324 to close the clamshell, the cover 325 is received within the container 329 and the first edge 323 is abutted against the second edge 327, thereby providing a positive enclosure of the content within the clamshell. The first edge 323 includes a textured tab 330, which extends beyond the second edge 327 to provide a mechanism to facilitate opening and closing the clamshell.

Figure 7:
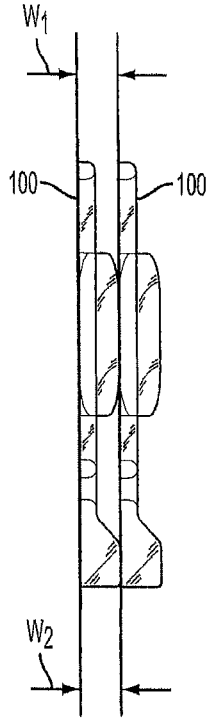
FIG. 7 is a side elevation view of the blister card shown in FIG. 1.

A plurality of blister cards 100 (for example, two or three) are stacked in the clamshell 320. As shown in FIG. 7 illustrating a side elevation view of the blister card 100, the blister 122 has a first lateral width W1 and the foot portion 142 has a second lateral width W2 for serving as a spacer between two adjacent blister cards. The second lateral width W2 is equal to or greater than the first lateral width W1, such that when a plurality of blister cards 100 are stacked within the clamshell 320, the blister cards are prevented from jamming into each other, thereby providing a neat appearance of the articles and stabilizing the blister cards in the clamshell. Furthermore, the foot portion protects the article received in the blister by distributing force that could be potentially applied on the article.

Figure 8:
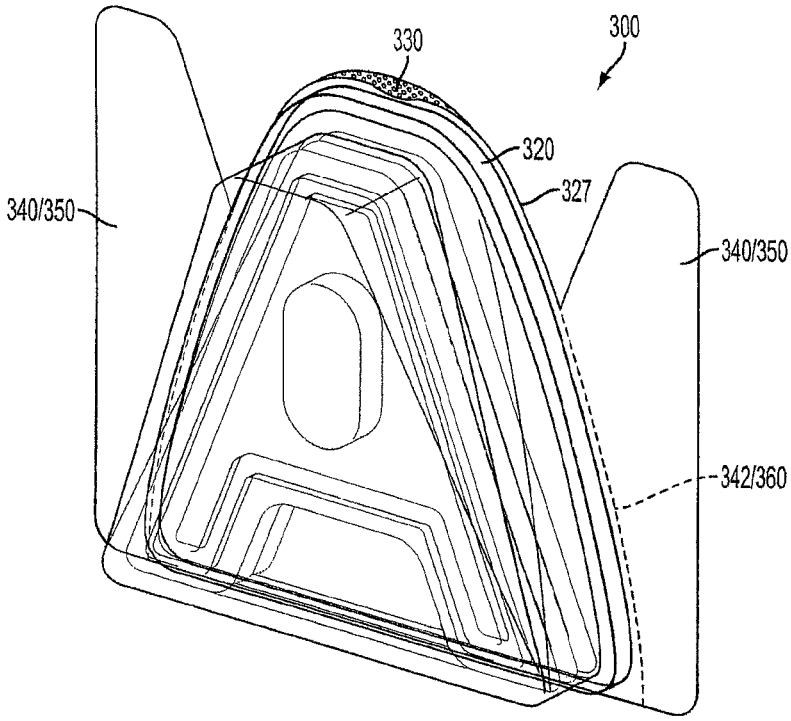
FIG. 8 is a perspective view of the clamshell shown in FIG. 6.

FIG. 8 shows the mountable receptacle 300 prior to being attached to the paperboard 200. The mountable receptacle 300 further includes at least one substantially planar extension 340 detachably connected to the clamshell 320 through a breakable mechanism 342.

The extension 340 can be of any suitable or desirable shape or profile. In the shown embodiment, the mountable receptacle 300 includes a pair of wing-shaped extensions 350 disposed at either side of the clamshell 320, longitudinally opposite to one another. The wing-shaped extensions 350 are connected to at least the second edge 327 of the second portion 324 of the clamshell 320 through the breakable mechanism 342.

The mountable receptacle 300 can be mounted onto a surface 220 (shown in FIG. 5) of the paperboard 200 by attaching the planar extensions 240 to the surface 220. The mountable receptacle 200 can be made of a plastic material, and the planar extensions 240 can be partially or fully spot-welded or faced sealed to the surface 220. The planar extensions 240 can also be connected to both the first edge 323 and second edge 327 through the breakable mechanism 342.

The breakable mechanism 342 permits a legitimate end user to intentionally detach the clamshell 320 from the paperboard 200 without compromising the integrity of the clamshell, such that the clamshell 200 can be reused with its full function maintained. For example, the clamshell can be reused to contain articles different from the previous content of the clamshell. Furthermore, breakage of the breakable mechanism 342 provides a tamper-evident feature for the package.

In the shown embodiment, the breakable mechanism 342 includes a plurality of perforations 360. However, the breakable mechanism 342 can include a variety of implements without departing from the invention, such as, laser scoring, locally weakened material and the like. In addition, the breakable mechanism 342 can be selectively designed and formed to provide a theft deterrent feature. For example, the pattern of the perforations 360 can be designed to have more compact perforations from the top of the clamshell 320, which requires extra forces applied from the top of the clamshell to initiate the tear-off the clamshell. The laser scoring or the locally weakened material can also be selectively designed to require extra efforts to initiate the tear-off operation.

Once the mountable receptacle 300 is mounted to the paperboard 200 as shown in FIG. 5, a grab-and-go package 1000 is provided, which permits a user to detach the clamshell 320 from the paperboard 100 by breaking the breakable mechanism 342. The detached clamshell 320 is reclosable and reusable, which permits the user to access the contained article, such as pharmaceuticals, multiple times. The provision of the textured tab 330 permits the user to conveniently open and close the clamshell 320.

Figure 9:
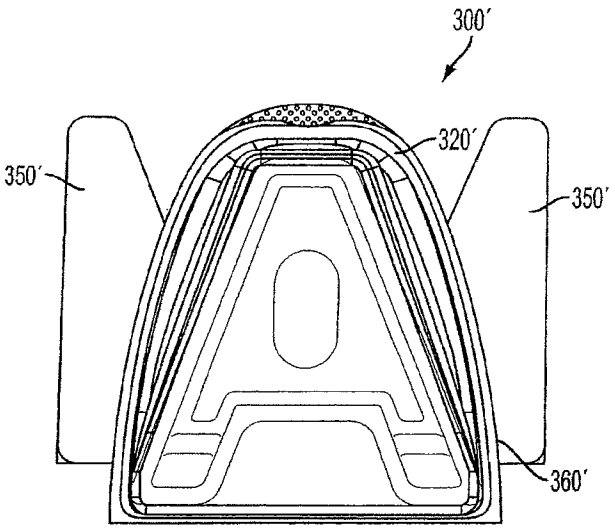
FIG. 9 is a perspective view of a mountable receptacle having a clamshell according to yet another embodiment of the present invention.
Figure 10:
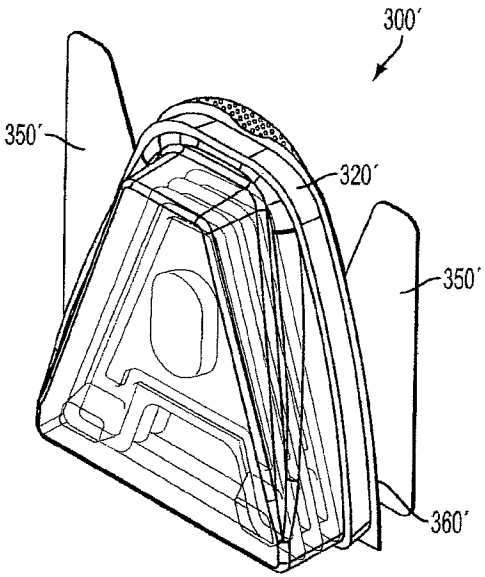
FIG. 10 is a front elevation view of the mountable receptacle shown in FIG. 9.

FIGS. 9 and 10 illustrate a mountable receptacle 300' according to another embodiment of the present invention. The mountable receptacle 300' includes a clamshell 320', which is the same or similar to the clamshell 320. The mountable receptacle 300' further includes a pair of wing-shaped extensions 350', which are connected to the clamshell 320' through a plurality of perforations 360'. In this embodiment, the lower end of the wing-shaped extensions 350' are disposed above the lower end of the clamshell 320', and the perforations 360' extend at the middle portion of the clamshell 320'. A skilled person in the art understands that the pattern of the perforations can be designed to be symmetrical, asymmetrical or a combination thereof, depending on the design considerations.

In the shown embodiment, the clamshell 320 has a profile substantially matching the A-shaped blister cards 100, although the profile can be of any suitable shape. The clamshell can have a variety of shapes, including but not limited to, square, rectangular, triangle, round, oval and the like. In addition, the clamshell can be designed to follow the profile of any number, letter, symbol, animal or object. The dimension of the clamshell 320, particularly the lateral dimension of the clamshell, is selected to allow the clamshell or the package 1000 to stand by itself on a shelf, which offers the user more options to organize the package.

The paperboard 200 can have an opening 240, which provides a pegging mechanism for the package. For example, the opening 240 can be in the shape of a sombrero slot or a round hole. Alternatively, the opening can be filled with a removable paper material, or not be presented at all.

Figure 11:
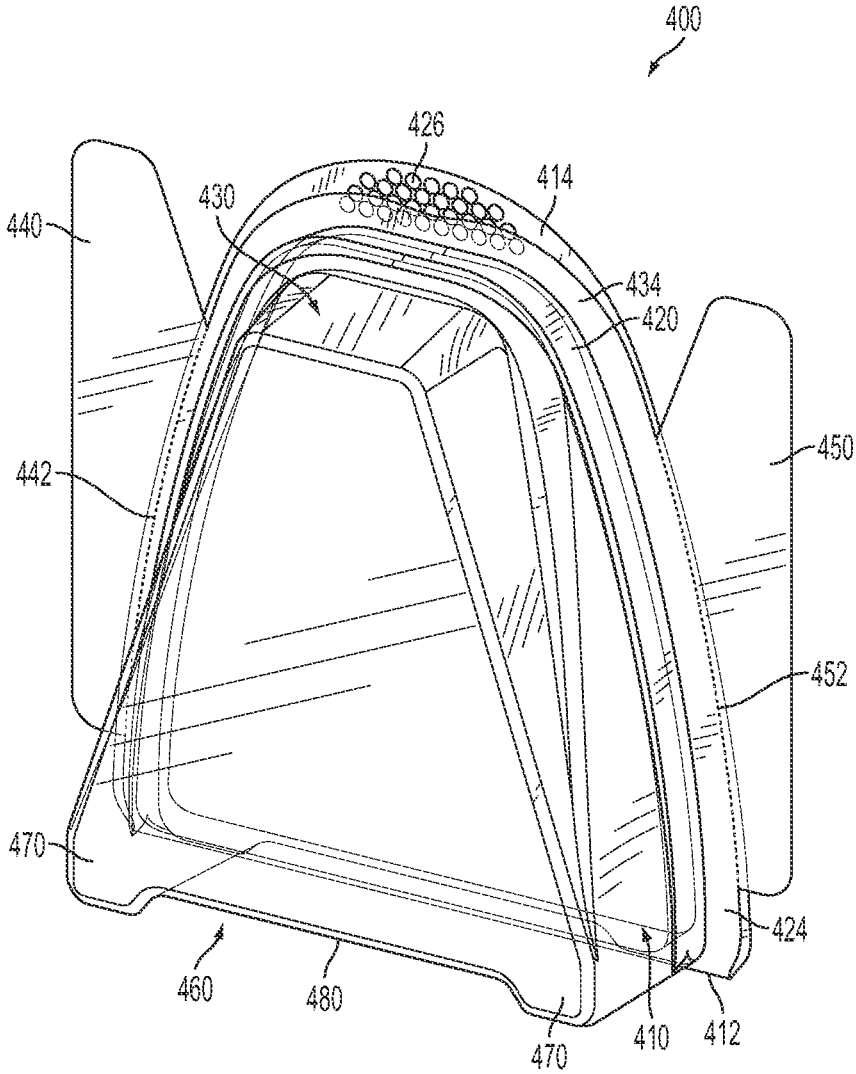
FIG. 11 is a perspective view of a mountable receptacle having a clamshell according to still another embodiment of the present invention.
Figure 12:
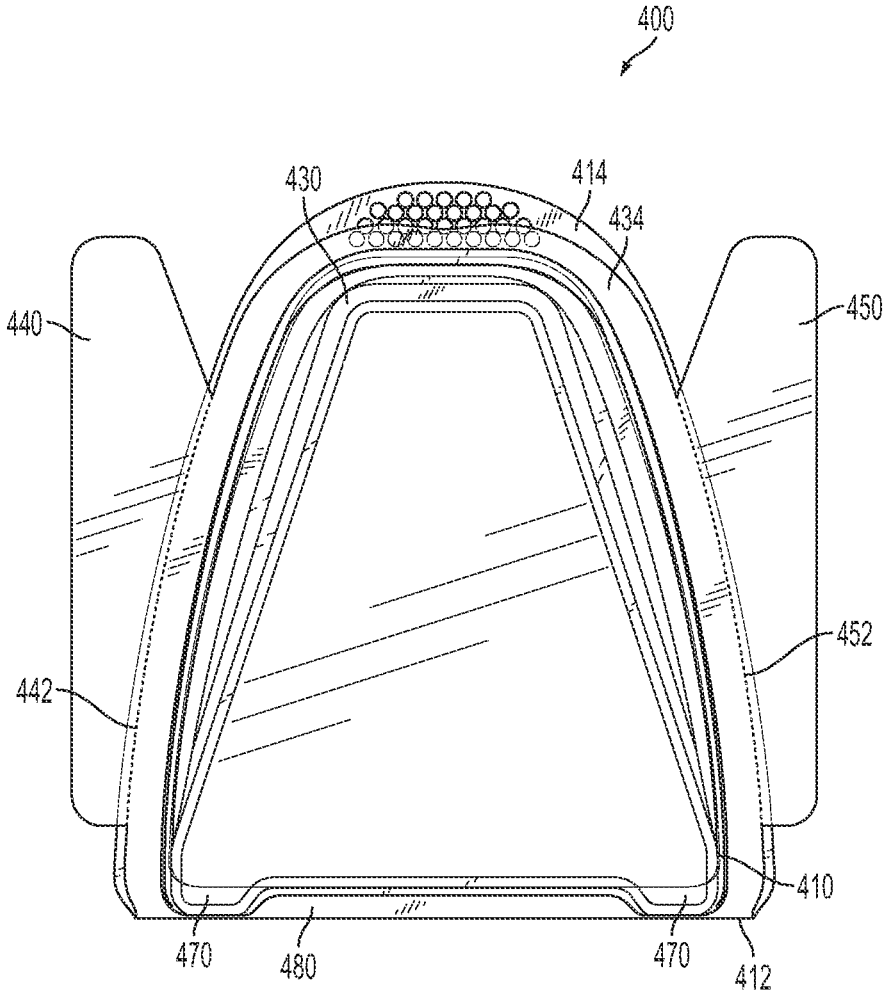
FIG. 12 is a front elevation view of the mountable receptacle shown in FIG. 11.
Figure 13:
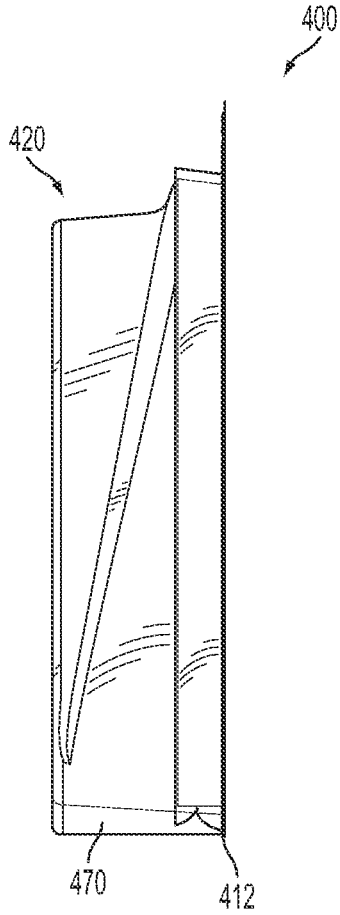
FIG. 13 is a side elevation view of the mountable receptacle shown in FIG. 11.

FIGS. 11-13 illustrate a mountable receptacle 400 according to yet another embodiment of the present invention. The mountable receptacle 400 can be mounted to the paperboard 200. The mountable receptacle 400 includes a clamshell 420 for receiving one or more blister cards, and a pair of substantially planar extensions 440 and 450 detachably connected to the clamshell 420 through a breakable mechanism, for example, a plurality of perforations 442 and 452.

The clamshell 420 includes, for example, a cover portion 410 and a container portion 430, which are pivotably connected to each other through a hinge 412 (such as, a perfed hinge or perforated hinge), to define a space between the two portions for accommodating articles (such as, the blister cards 100). The cover portion 410 includes a first substantially planar edge 414, which substantially surrounds the cover portion 410. The container portion 430 includes a second substantially planar edge 434, which opposes and abuts the first edge 414 to define a substantially planar flange area 424 of the clamshell, when the cover portion 410 and the container portion 430 are pivoted through the hinge 412 to meet one another. The planar flange area 424, compared with that of the clamshell 320, is relatively wider to provide a better grip for a user when the user needs to open the clamshell. The clamshell further includes a textured tab 426, which can be formed with the first planar edge 414 and/or the second planar edge 434. For example, the textured tab 426 can include a plurality of dimples or raised nubs, which are bigger and more widely distributed as compared with those of the clamshell 320, for further facilitating gripping and opening of the clamshell 420.

Additionally, the clamshell 420 includes a bottom portion 460, which enables or further enhances the ability of the clamshell to stand independently. The bottom portion 460 can be formed with either portion of the clamshell and includes a pair of opposite feet 470 spaced by a void 480. The number of the feet of the clamshell and the dimension of the feet and the void can be adjusted, depending on the circumstances in which the clamshell is used.

The package according to the present invention, including the A-shaped blister card and clamshell, facilitates marketing and enhances brand recognition of the article, such as pharmaceuticals.

The features of the present invention as applied to various specific embodiments thereof have been shown and described. It will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A package for an article, comprising:

a paperboard on which information related to the article is shown;

a receptacle detachably mounted to the paperboard, comprising:

a clamshell comprising a first portion having a first edge and a second portion having a second edge which opposes the first edge; and at least one substantially flat extension connected at least to the second edge through a breakable mechanism, wherein the at least one substantially flat extension is attached to a surface of the paperboard to attach the clamshell to the paperboard, such that the clamshell can be detached from the paperboard by breaking the breakable mechanism; and at least one blister card received within the clamshell, the at least one blister card comprising a blister sheet having at least one blister, said at least one blister extending from a surface of the blister sheet and defining a concave space for loading the article;

wherein the at least one blister card further comprises a peripheral rib extending perpendicularly from said surface of the blister sheet for at least partially surrounding the at least one blister, wherein the at least one blister has a first width extending perpendicularly from the blister sheet, and the rib comprises at least one foot portion having a second width extending perpendicularly from the blister sheet, the second width being equal to or larger than the first width such that a plurality of the blisters cards can be stacked within the clamshell without the blisters interfering with one another.

2. The package according to claim 1, wherein the at least one substantially flat extension comprises a pair of longitudinal wings disposed at either side of the clamshell, opposite to one another.

3. The package according to claim 1, wherein the at least one substantially flat extension is spot-welded or face-sealed to the surface of the paperboard.

4. The package according to claim 1, wherein the blister sheet and the peripheral rib are substantially A-shaped.

5. The package according to claim 4, wherein the clamshell has a profile substantially matching the A-shaped blister sheet.

6. The package according to claim 1, wherein the clamshell further comprises a hinge for pivotably joining the first portion and the second portion.

7. The package according to claim 1, wherein the breakable mechanism comprises a plurality of perforations.

8. The package according to claim 1, wherein the clamshell comprises a bottom portion for permitting the clamshell to stand independently and the bottom portion comprises a pair of feet spaced by a void.

9. A method of producing a package for an article, the package comprising a paperboard and a clamshell mountable to the paperboard, the method comprising:

providing at least one substantially planar extension for the clamshell;

connecting the at least one substantially planar extension to the clamshell through a breakable mechanism;

attaching the at least one substantially planar extension to a surface of the paperboard to attach the clamshell to the paperboard; and placing a blister card within the clamshell, wherein the blister card comprises a blister sheet having at least one blister, said at least one blister extending from a surface of the blister sheet and defining a concave space for loading the article, wherein the at least one blister card further comprises a peripheral rib extending perpendicularly from said surface of the blister sheet for at least partially surrounding the at least one blister, and wherein the at least one blister has a first width extending perpendicularly from the blister sheet, and the rib comprises at least one foot portion having a second width extending perpendicularly from the blister sheet, the second width being equal to or larger than the first width such that a plurality of the blisters cards can be stacked within the clamshell without the blisters interfering with one another.

10. The method according to claim 9, wherein the providing step comprises providing a pair of wing-shaped extensions.

11. The method according to claim 9, wherein the connecting step comprises connecting a pair of wing-shaped extensions to either side of the clamshell, respectively, through a plurality of perforations.

12. The method according to claim 9, wherein the attaching step comprises at least partially spot welding or heat sealing the at least one substantially planar extension to the surface of the paperboard.

13. A package for an article, comprising:

a paperboard on which information related to the article is shown;

a receptacle detachably mounted to the paperboard, comprising:

a clamshell comprising a first portion having a first edge and a second portion having a second edge which opposes the first edge; and at least one substantially flat extension connected at least to the second edge through a breakable mechanism, wherein the at least one substantially flat extension is attached to a surface of the paperboard to attach the clamshell to the paperboard, such that the clamshell can be detached from the paperboard by breaking the breakable mechanism; and wherein the clamshell comprises a bottom portion for permitting the clamshell to stand independently and the bottom portion comprises a pair of feet spaced by a void.

* * * * *